US009957143B2

(12) United States Patent
Ruby

(10) Patent No.: US 9,957,143 B2
(45) Date of Patent: May 1, 2018

(54) DEVICE FOR MOVING CONSTRUCTION BARRELS

(71) Applicant: K & S 5000 Holdings, LLC, Dry Ridge, KY (US)

(72) Inventor: Kyle Ruby, Dry Ridge, KY (US)

(73) Assignee: K & S 5000 HOLDINGS, LLC, Dry Ridge, KY (US)

( * ) Notice: Subject to any disclaimer, the term of this patent is extended or adjusted under 35 U.S.C. 154(b) by 0 days. days.

(21) Appl. No.: 15/176,593

(22) Filed: Jun. 8, 2016

(65) Prior Publication Data

US 2016/0355387 A1 Dec. 8, 2016

Related U.S. Application Data

(60) Provisional application No. 62/172,275, filed on Jun. 8, 2015.

(51) Int. Cl.

| | |
|---|---|
| ***B66F 13/00*** | (2006.01) |
| ***B66F 19/00*** | (2006.01) |
| ***E01F 9/70*** | (2016.01) |

(52) U.S. Cl.

CPC ..... *B66F 19/00* (2013.01); *E01F 9/70* (2016.02)

(58) Field of Classification Search

CPC ... E01F 9/00; E01F 9/627; E01F 9/673; E01F 9/70; E01F 13/00; E01F 19/00

See application file for complete search history.

(56) References Cited

U.S. PATENT DOCUMENTS

| | | | | |
|---|---|---|---|---|
| 8,191,951 | B2 | 6/2012 | Johnson et al. | |
| 2005/0196257 | A1* | 9/2005 | Villeneuve | E01F 9/70 414/434 |
| 2013/0089397 | A1* | 4/2013 | Downing | B60P 1/6454 414/494 |
| 2013/0094928 | A1* | 4/2013 | McFarland | B62B 1/12 414/457 |

OTHER PUBLICATIONS

Safety Shift article—from http://www.safetyshift.com/why-safety-shift/; printed May 11, 2015.

* cited by examiner

*Primary Examiner* — David Bryant
*Assistant Examiner* — Nirvana Deonauth
(74) *Attorney, Agent, or Firm* — King & Schickli, PLLC

(57) ABSTRACT

An apparatus removably attached to a vehicle for moving a plurality of traffic barrels. The apparatus includes a mounting device configured for removably attaching to the vehicle. The apparatus further includes a receiving device having a first end and a second end, wherein the receiving device is configured for attaching to the mounting device at the first end and at least one tube connecting to the second end of the receiving device. Each of the plurality of traffic barrels slide along the at least one tube into a desired position.

17 Claims, 13 Drawing Sheets

DEVICE FOR MOVING CONSTRUCTION BARRELS

This application claims the benefit of U.S. Provisional Patent Application Ser. No. 62/172,275, filed on Jun. 8, 2015, the disclosure of which is incorporated herein by reference.

TECHNICAL FIELD

This disclosure relates generally to mounting devices and, more particularly, to a device removably mountable on a vehicle for more efficiently moving traffic and construction barrels and related traffic control equipment.

BACKGROUND

In the United States, millions of dollars are annually allocated for roads and highways to undergo construction and repair. Generally, traffic barrels are used during road construction work to warn and alert drivers of the construction work and presence of construction workers and equipment, redirect traffic in the event of lane and ramp closures, and to protect workers. Traffic barrels are typically placed on the shoulder of the road and later moved out onto the road.

The task of moving the barrels onto the roadway may be accomplished by one or more individuals who walk along the highway and manually carrying and/or dragging each barrel from the shoulder onto the highway. Traffic barrels weigh about 25-30 pounds, so this is a time-consuming task due to the weight of the barrels and the distance that must be traveled. Not only is this method of moving the traffic barrels inefficient in term of man-hours and labor expense, but it is dangerous. Indeed, hundreds of construction workers are killed annually along highways while manually moving traffic barrels.

To alleviate the problem of manually moving traffic barrels by hand, it is known to drive a truck along the highway and have workers on the truck move the barrels. While this manner of moving the barrels is typically safer for the workers and somewhat faster, it still suffers from certain drawbacks. For example, it typically requires multiple workers (up to five) positioned on the truck and passing the barrels from their original location to their desired location. As a result, it still requires a number of construction workers and a substantial amount of time, which decreases the inefficiency of the operation.

Accordingly, there is a need for a more effective system for placement and removal of traffic barrels from highways. The system for placement and removal of traffic barrels from highways should limit the number of workers necessary for the task, result in more quickly placing and removing the traffic barrels and improve safety for the workers assigned to this task. The system should be able to be adjustably and removably mounted to a variety of different vehicles. The system should be further configurable to have removably attachable extensions to aid in moving traffic barrels different distances, i.e., across one or more lanes of traffic.

SUMMARY

In accordance with one aspect of the disclosure, an apparatus removably attached to a vehicle for moving a plurality of traffic barrels is disclosed. The apparatus includes a mounting device configured for removably attaching to the vehicle. The apparatus further includes a receiving device having a first end and a second end, wherein the receiving device is configured for attaching to the mounting device at the first end and at least one tube connecting to the second end of the receiving device. Each of the plurality of traffic barrels slide along the at least one tube into a desired position.

In various embodiments, the mounting device may be configured to be adjusted for mounting to different types of vehicles. Furthermore, a plurality of rollers may be positioned on the at least one tube for aiding in sliding the plurality of traffic barrels into the desired position. The plurality of rollers may be equally spaced along the at least one tube. The plurality of rollers may further include two different types of rollers. An extension hook may be attached to an end of the at least one tube for capturing each of the plurality of traffic barrels. A vertical pin may be attached to a distal end of the extension hook. The tube may extend at an approximately forty-five degree angle.

In yet another aspect of the disclosure, an apparatus for moving a plurality of traffic barrels is disclosed. The apparatus includes: (1) a mounting bracket; (2) a receiving device configured for attaching to the mounting bracket; (3) a connecting device configured for attaching to the receiving device; and (4) a primary barrel moving tube configured to connect to the connecting device for moving the plurality of traffic barrels.

In one embodiment, the mounting bracket may have two parallel spaced horizontal bars. The mounting bracket further may have a first pair of horizontal spacers corresponding to one of the parallel spaced horizontal bars and a second pair of horizontal spacers corresponding to a second one of the parallel spaced horizontal bars. The first and second pair of horizontal spacers is configured to enable the device to be adjusted for mounting to different vehicles. The mounting bracket may have at least one vertical tube for connecting the two parallel spaced horizontal bars.

In another embodiment, the receiving device may have a plurality of bars extending outward in a direction perpendicular to the mounting bracket. The plurality of bars meets at a connection point. A body shield may be positioned on the receiving device above the connection point. The connecting device may have a first part connecting to the receiving device and a second part connecting to the primary barrel moving tube. The second part may be a clevis fastener. The connecting device may further have a caster wheel. The apparatus may be incorporated into a vehicle.

Another related aspect of this disclosure is a system for utilizing a vehicle to move traffic barrels from a first position to a second position. The system includes a mounting device configured for removably attaching to a front of the vehicle. The system further includes an extension tube having a body with a curved hooked end and a plurality of rollers extending substantially along an entirety of the body. The extension tube is configured for contacting the plurality of traffic barrels such that the curved hooked end of the extension tube engages one of the plurality of traffic barrels at the first position and the plurality of rollers slide the one of the plurality of traffic barrels along the body of the extension body into the second position.

BRIEF DESCRIPTION OF THE DRAWINGS

The accompanying drawings/photographs incorporated in and forming a part of the specification, illustrate several aspects of this disclosure, and together with the description serve to explain the principles of the disclosure. In the drawings.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the invention is defined only by the appended claims and their equivalents. In accordance with the disclosure, an apparatus for moving traffic barrels is hereinafter described.

Figure 1:
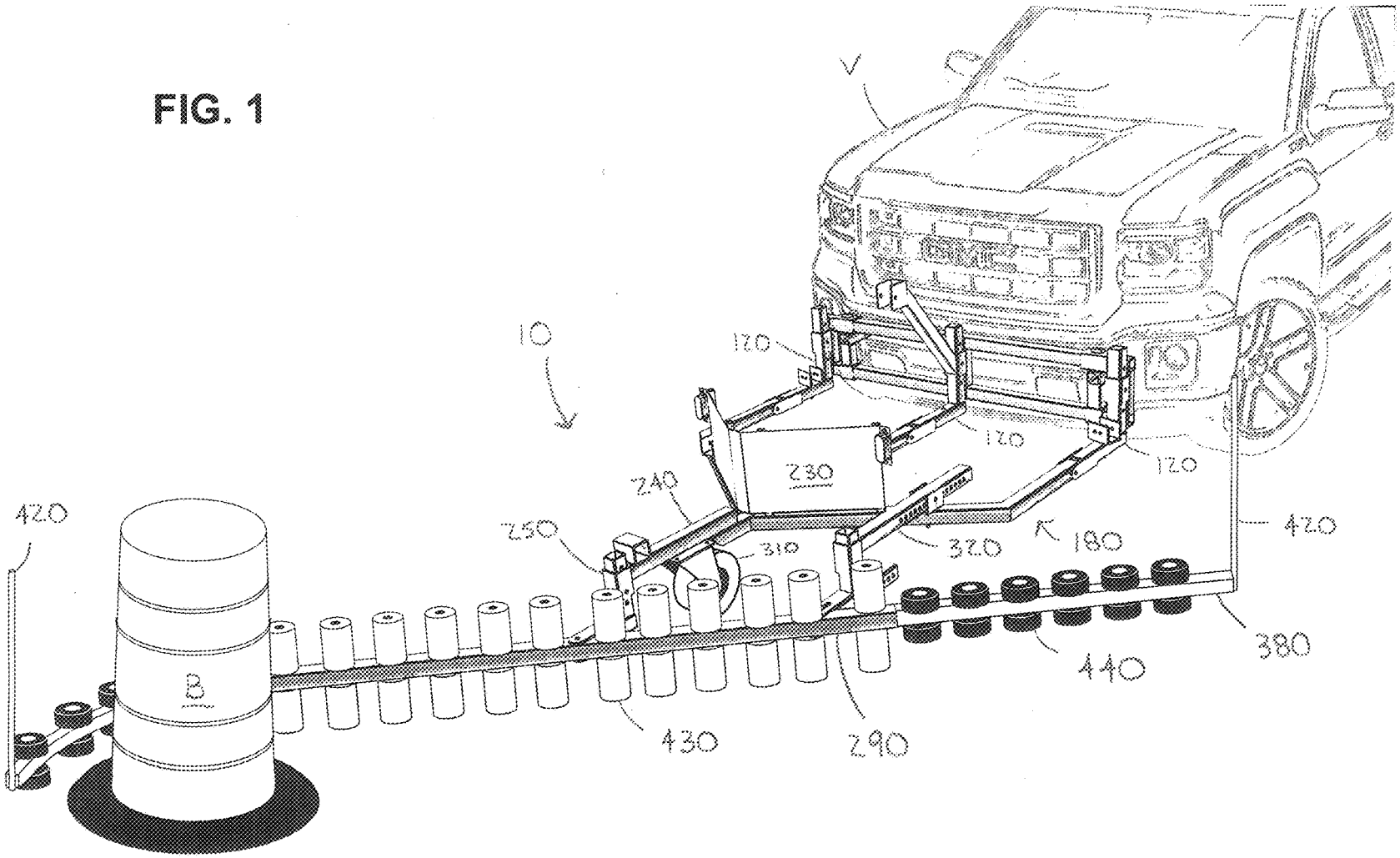
FIG. 1 is a perspective view of an apparatus for moving traffic barrels forming one aspect of this disclosure.
Figure 2B:
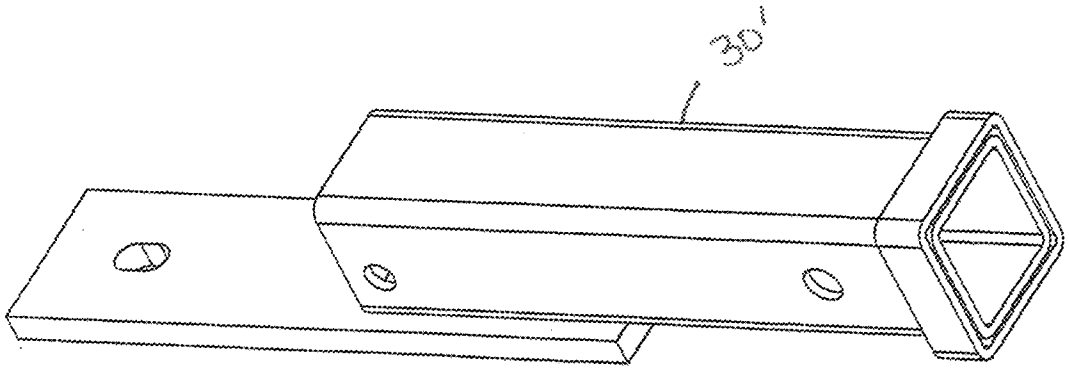
FIG. 2*b* is a perspective view of another mount assembly forming one aspect of this disclosure.
Figure 2A:
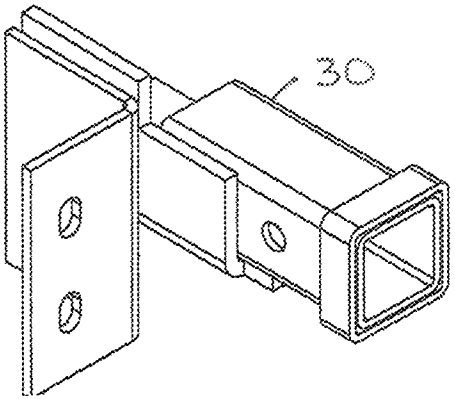
FIG. 2*a* is a perspective view of a mount assembly forming one aspect of this disclosure.

As shown in FIGS. 1-16, the apparatus 10 for moving traffic barrels (B) is illustrated. The apparatus 10 is capable of being removably mounted to the front of a vehicle (V) or truck via a mounting bracket 20. The mounting bracket 20 is securely, yet removably attached in place of vehicle tow hooks to the frame at the front of the vehicle (V). Specifically, each of the tow hooks of the vehicle are removed and replaced with a mount assembly 30. As shown in FIG. 1, the mounting bracket 20 is removably mounted to the vehicle (V) below the front grill of the vehicle. As discussed in more detail below, the mounting bracket 20 is configured to be modified to mount to nearly all types of trucks and other vehicles. The mount assemblies 30 are typically specific for particular types of vehicles, such as Ford, Chevrolet, Dodge and the like. Two different embodiments of the mount assemblies 30, 30$^1$ are shown in FIGS. 2*a* and 2*b*. These mount assemblies are bolted to the truck.

Figure 3B:
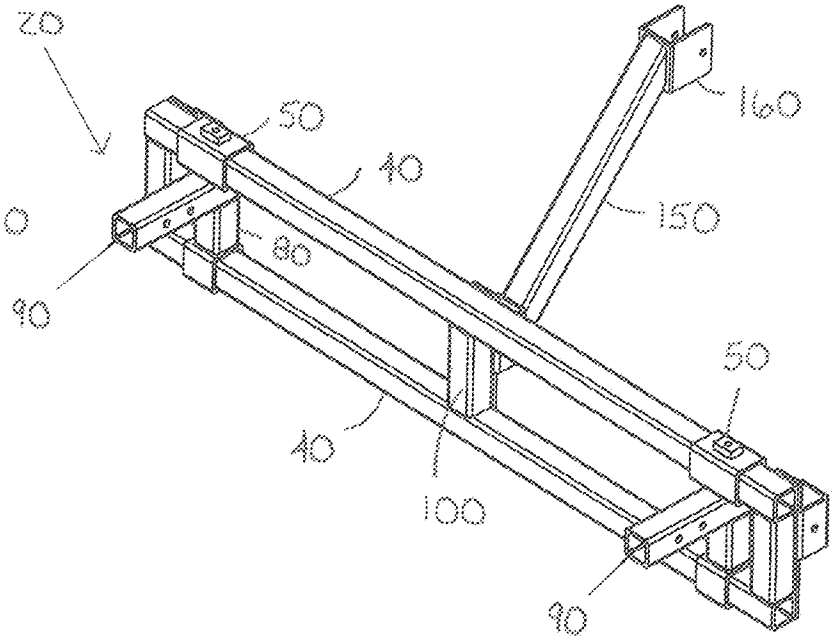
FIG. 3*b* is a rear perspective view of the mounting bracket forming one aspect of this disclosure.
Figure 3A:
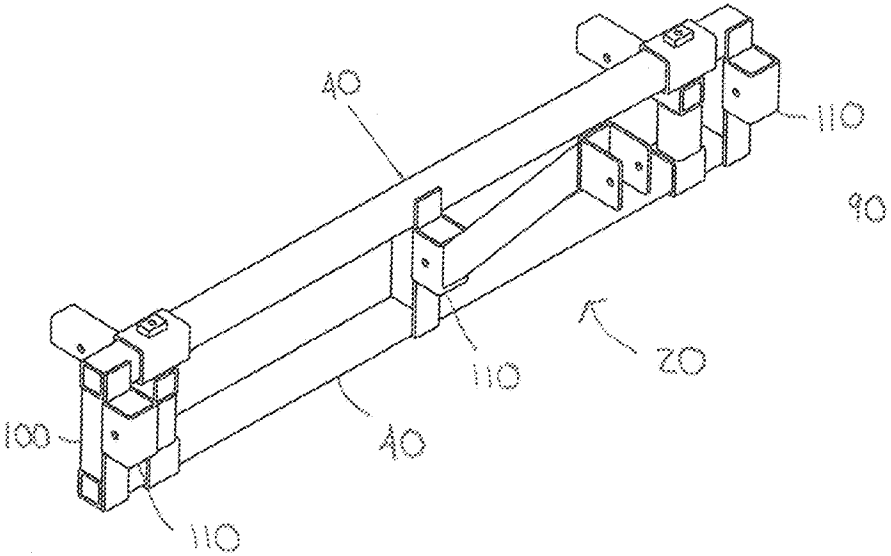
FIG. 3*a* is a front perspective view of a mounting bracket forming one aspect of this disclosure.
Figure 4:
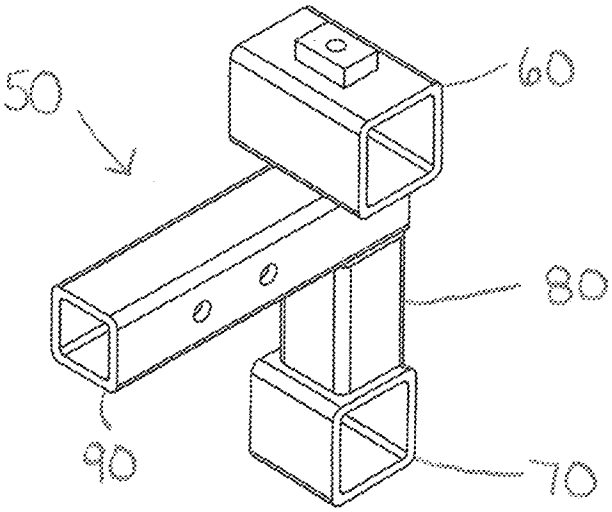
FIG. 4 is a perspective view of a horizontal spacer used with the mounting bracket forming one aspect of this disclosure.

Turning to FIGS. 3*a* and 3*b*, the rear end of the mounting bracket 20 is removably attached or mounted to the vehicle (V). The mounting bracket 20 includes two spaced, parallel horizontal bars 40. The horizontal bars 40 have a pair of horizontal spacers 50 located thereon, which serve the function of being configured to move laterally on the horizontal bars 40 to accommodate mounting to different vehicles, including makes and models. Each of the pair of horizontal spacers 50 are attached to both horizontal bars 40 (upper and lower horizontal bars). As best shown in FIG. 4, each of the pair of horizontal spacers 50 has two receivers 60, 70 connected by a vertical bar 80 and a horizontal mounting tube 90. The two receivers 60, 70 receive the upper and lower horizontal bars 40, respectively. The horizontal mounting tube 90 extends perpendicular to the vertical bar 80 for mounting to the vehicle (V) via the mounting assemblies 30, i.e., the horizontal mounting tube 90 is received and pinned to a mounting assembly 30. When the horizontal spacers 50 are properly positioned, they may be removably bolted or fastened. The horizontal spacers 50 enable the device to be adjusted in relatively small increments to maximize safety spacing of device as dictated by individual traffic conditions and proximity. The horizontal bars 40 are further supported and connected by at least one vertical tube 100. In the embodiment illustrated in FIGS. 3*a* and 3*b*, three vertical tubes 100 are used.

Figure 5:
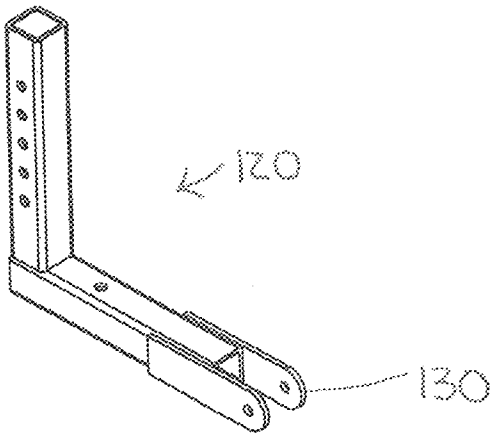
FIG. 5 is a perspective view of an L-shaped bar forming one aspect of this disclosure.

The mounting bracket 20 further has three vertical receivers 110 for receiving three corresponding L-shaped bars 120. As shown in FIG. 5, each of the L-shaped bars 120 having multiple apertures in the vertical portion of their "L" for locking to the respective vertical receiver 110 via a pinned connection. The multiple apertures allow vertical adjustment of the apparatus to allow optimal adjustment of the device based on road and traffic conditions to operate efficiently and safely. The horizontal portion of the "L" for each of the L-shaped bars 120 have a fastener 130 attached to its end, such as a clevis fastener, which connects the L-shaped bar to a wheel and mount receiving device 180 discussed in more detail below.

Figure 6:
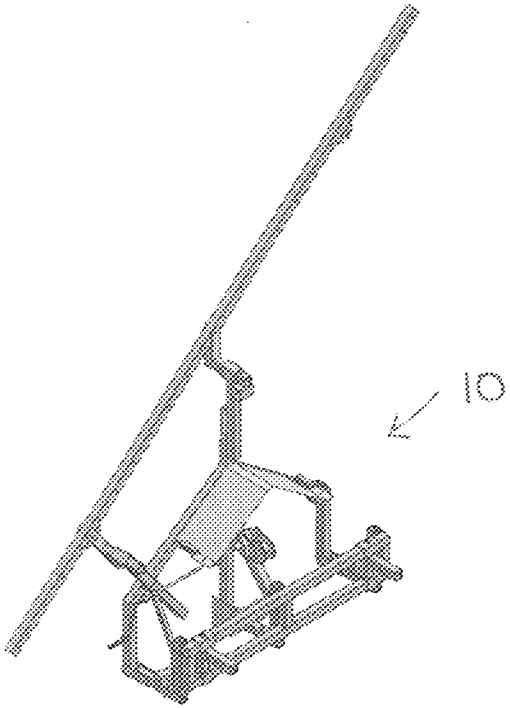
FIG. 6 is a perspective view of the apparatus for moving traffic barrels in an upright position forming one aspect of this disclosure.

As perhaps best shown in FIG. 3*b*, the middle vertical receiver 110 (of the three vertical receivers) has an upright attachment 150 attached thereto. As illustrated in FIG. 6, the upright attachment 150 extends vertically at an approximate forty-five degree angle for receiving and locking via a pinned connection a front portion of the apparatus 10 in an upright configuration for transport on the vehicle. The distal end of the upright attachment has a catch 160 for receiving a portion of the apparatus for transport. For example, the apparatus 10 may be extended or retracted upward parallel to the front face or grill of the vehicle such that the apparatus does not contact the highway or ground. As perhaps best shown in FIG. 7*a*, the mounting bracket 20 may have a removable winch 170 attached thereto for assisting in raising or lowering the apparatus 10 from an extended or retracted position. Advantageously, this feature allows the apparatus to be easily transported to and from the highway as well as on the highway without completely removing the apparatus from the transport vehicle, which reduces the time and effort in transporting the apparatus.

Figure 7A:
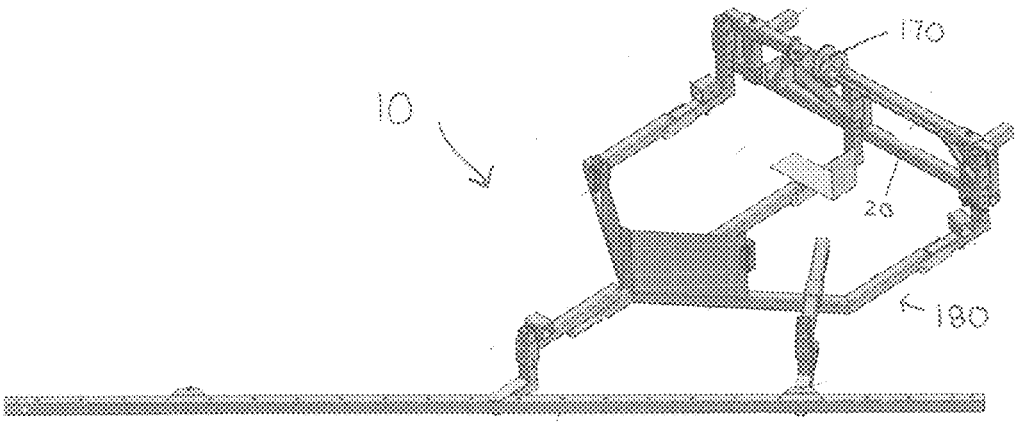
FIG. 7*a* is a front right side perspective view of the apparatus for moving traffic barrels forming one aspect of this disclosure.
Figure 7B:
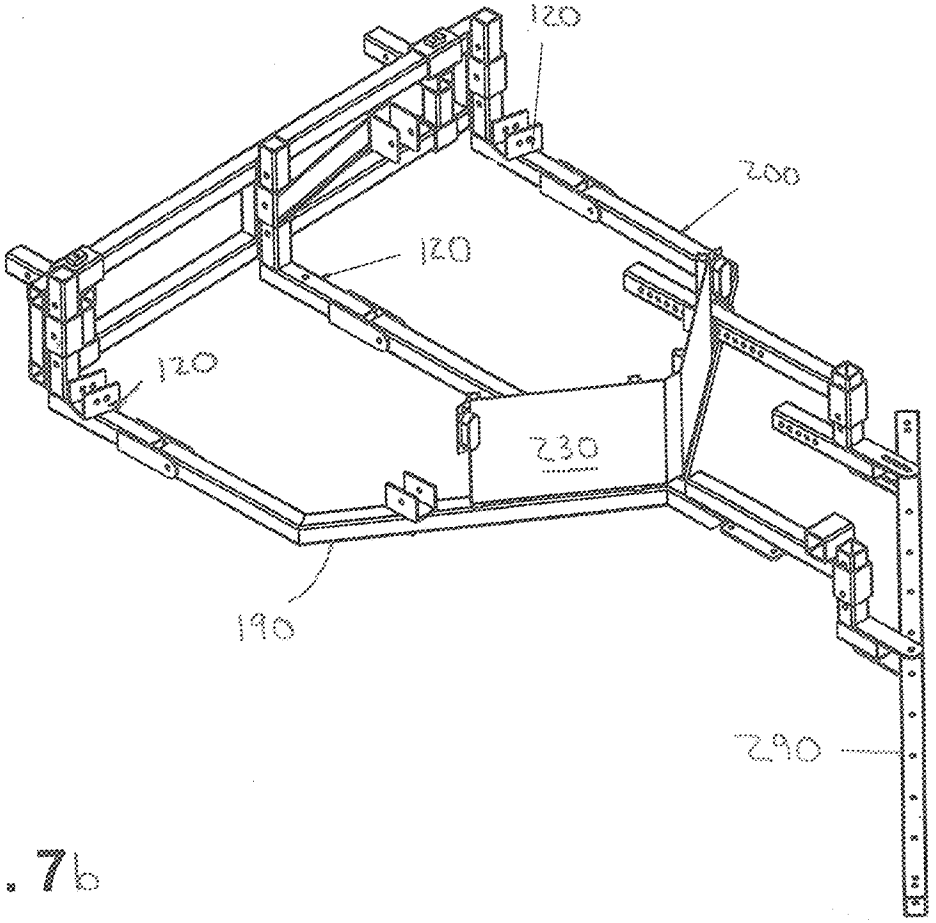
FIG. 7*b* is a front left side perspective view of the apparatus for moving traffic barrels forming one aspect of this disclosure.
Figure 7C:
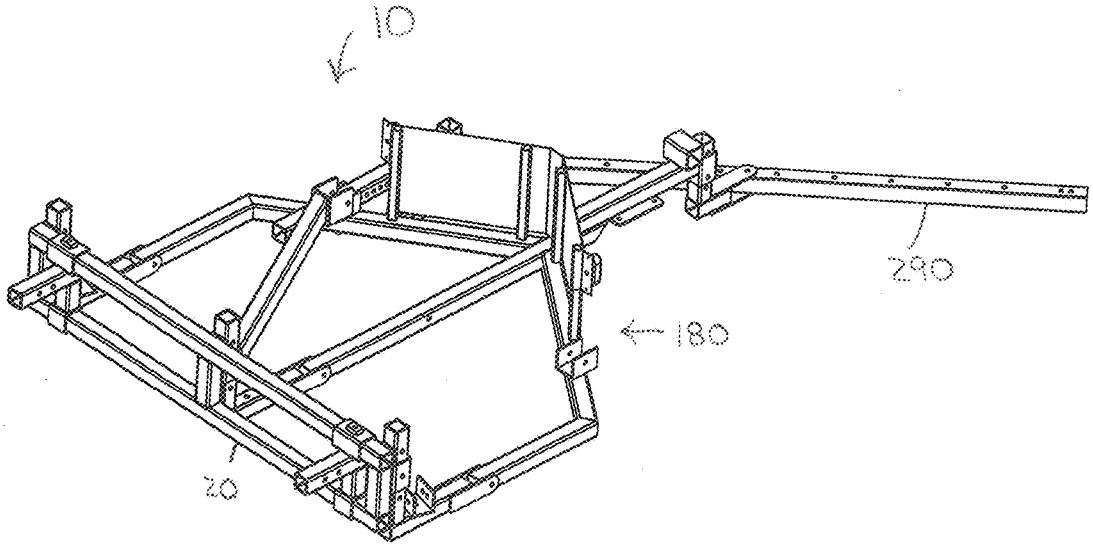
FIG. 7*c* is a rear perspective view of the apparatus for moving traffic barrels forming one aspect of this disclosure.
Figure 8A:
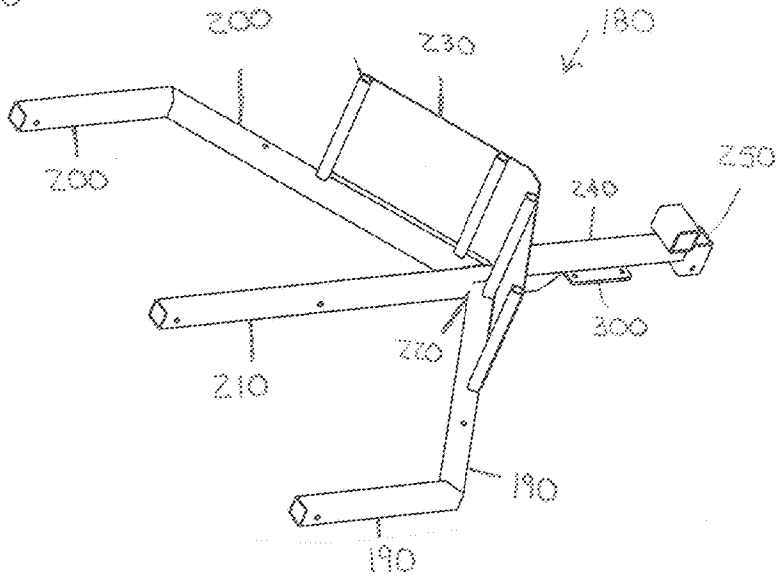
FIG. 8*a* is a front perspective view of a wheel and mount receiving device forming one aspect of this disclosure.
Figure 8B:
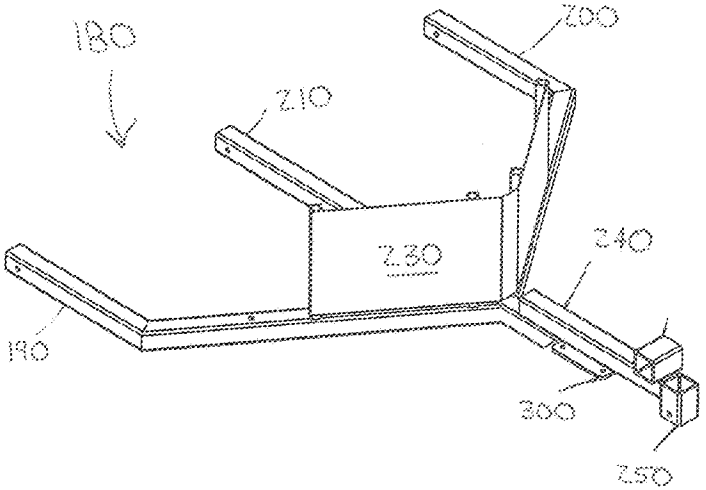
FIG. 8*b* is a rear perspective view of the wheel and mount receiving device forming one aspect of this disclosure.

With reference to FIGS. 7*b* and 7*c*, the horizontal portion of the L-shaped bars 120 extending in a direction perpendicular to the front plane of the vehicle (V) connects to the wheel and mount receiving device 180, which is essential for independent vertical movement of the entire device and enables precise adjustments dictated by varying road conditions. Turning to FIGS. 8*a* and 8*b*, the wheel and mount receiving device 180 has two outer bars 190 and 200 initially extending outward in a direction perpendicular to the front plane of the vehicle and then extending inward at an angle (around 45°) to connect to a middle bar 210 that extends perpendicular to the front plane of the vehicle. The first and second outer bars and the middle bar connect at a connection point 220. At the connection point 220, a V-shaped body shield 230 is positioned.

Figure 9:
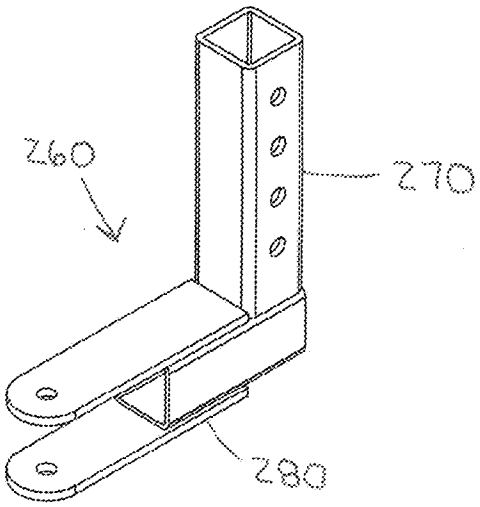
FIG. 9 is a perspective view of a primary connecting device for connecting a primary connector tube to a primary barrel moving tube forming one aspect of this disclosure.
Figure 10:
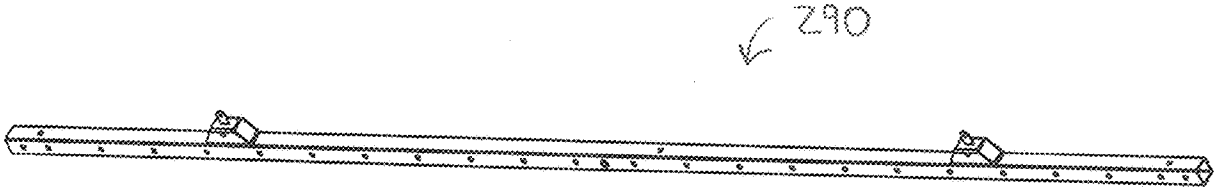
FIG. 10 is a perspective view of the primary barrel moving tube forming one aspect of this disclosure.
Figure 12:
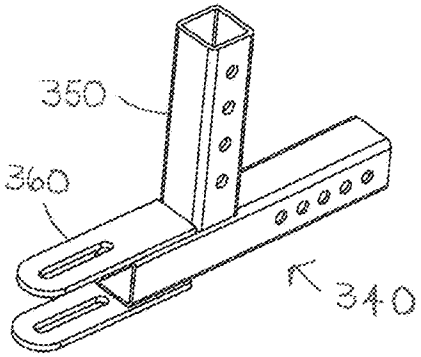
FIG. 12 is a perspective view of secondary connecting device for connecting an additional or secondary adjusting/connector tube to the primary barrel moving tube forming one aspect of this disclosure.

Turning back to FIG. 1, a horizontally extending primary connector tube 240 connects to the wheel and mount receiving device 180 at a first end. At a second end, the primary connector tube 240 has a receiver tube 250 for connecting to a primary connecting device 260. As best shown in FIG. 9, the primary connecting device 260 has a first upstanding part 270 with apertures for receiving the receiver tube 250 of the primary connector tube 240 at one end via a pinned connection. The primary connecting device 260 further has a second part 280 in the form of a clevis fastener at a second, opposite end. As discussed in more detail below, the clevis fastener is connected to a primary barrel moving tube 290 (as illustrated in FIG. 10) via a pinned connection for barrel transport. The second part 280 may take the form of other fastening or connecting devices for connecting the primary connecting tube 240 to the primary barrel moving tube 290 via the primary connecting device 260.

A plate 300 is positioned underneath the primary connector tube 240 between the connection point 220 and the receiver tube 250. At least one caster wheel 310 is mounted underneath the plate 300 of the primary connector tube 240 to support the arrangement with the mount receiving device 180 and aid in the movement of the apparatus 10.

Figure 11:
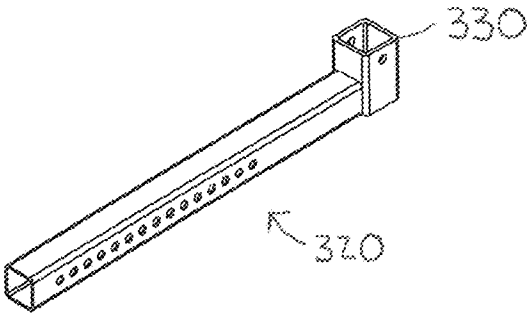
FIG. 11 is a perspective view of an additional or secondary barrel moving tube forming one aspect of this disclosure.
Figure 13:
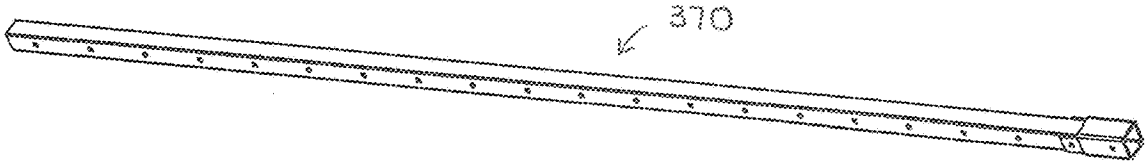
FIG. 13 is a perspective view of a double lane extender tube forming one aspect of this disclosure.
Figure 14:
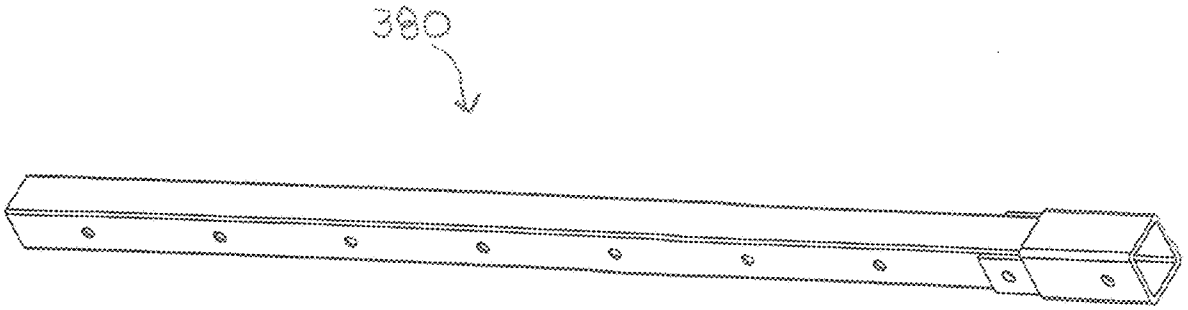
FIG. 14 is a perspective view of a single lane extender tube forming one aspect of this disclosure.
Figure 15:
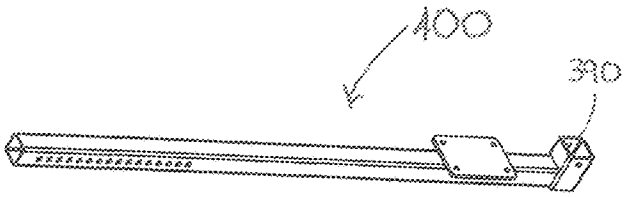
FIG. 15 is a perspective view of an additional connector or adjusting tube forming one aspect of this disclosure.

The mount receiving device 180 may be further connected to the primary barrel moving tube 290 via one or more additional adjusting tubes 320 having a pinned connection to the mount receiving device 180 and the primary barrel moving tube 290. As shown in FIG. 1, a single adjusting tube 320 is illustrated. One embodiment of the adjusting or secondary connector tube 320 is shown in FIG. 11. The adjusting tube 320 is connected to one of the outer bars 190 at a position adjacent to the body shield 230. The connection between the adjusting tube 320 and the outer bar 190 may be via a pinned connection through one of the apertures on the body of the adjusting tube 320 and a receiver device 330.

Similar to the primary connector tube 240, the adjusting tube 320 may be connected at an opposite end of the connection to one of the outer bars to a secondary connecting device 340 having a second clevis fastener 350, which in turns connects to the primary barrel moving tube 290 via a pinned connection. In more detail, FIG. 11 illustrates the receiver device 330 on one end of the adjusting tube 320. The receiver device 330 is engaged by the secondary connecting device 340 shown in FIG. 12. The secondary connecting device 340 has an upstanding part 350, which receives or engages the receiver device 330 to connect the secondary connecting device 340 to the secondary or adjusting tube 320. The secondary connecting device 340 further has a second clevis fastener 360 for attaching to the primary barrel moving tube 290. The secondary connecting device 340 also has a pivot or adjustable tension spring within the device such that when a barrel (B) contacts a hook 410 of the primary barrel moving tube 290, it acts as a shock-absorber to absorb the impact of the barrel to promote easier and more fluid travel of the barrel along the tube 290. In more detail, the spring attaches to an adjustable pin inside of the primary barrel moving tube via the second clevis fastener, which is slottedly connected to the primary barrel moving tube.

The one or more adjusting tubes 320 is important for device adjustment as it can be easily adjusted in or out via a single adjustment point. The adjusting tubes 320 may directly impact the angle of attack of the primary barrel moving tube 290. The angle selected determines the speed at which the barrel travels across the primary barrel moving tube 290, assuming a constant vehicle speed. Additionally, the angle selected impacts precise barrel travel termination point allowing for extremely precise barrel placement that is not possible using current methods. Additional caster wheels (not shown) may be positioned under the one or more adjusting tubes to aid in movement of the device.

The primary barrel moving tube 290 (shown in FIG. 10) extends away from the front face of the vehicle at an acute angle, such as forty-five degrees. The primary barrel moving tube 290 is configured to be able to receive at least one extension tubes (which may come in different lengths, such as the double lane extender tube 370 shown in FIG. 13 and the single lane extender tube 380 shown in FIG. 14) to move the barrels varying lengths. For example, if the apparatus 10 is being used to move the traffic barrels over a short distance, the primary barrel moving tube 290 may not require any extension tubes. However, if it is desired to move the barrels over one lane of traffic, the single lane extension tubes 380 may be connected to the primary barrel moving tube 290 as illustrated in FIG. 1. With the single lane extension tube 380, the apparatus does not necessarily need any additional connector adjusting tubes, i.e., only the primary connector tube 240 and the additional adjusting tube 320 are connected to the primary barrel tube 290 and no connector or adjusting tubes are directly connected to the single lane extension tube 380.

If it is desired to move the barrels over multiple lanes of traffic, one or more double lane extension tubes 370 may be connected to one end of the primary tube 290. If the double lane extension tube is used, an additional connector or adjusting tube 400 (shown in FIG. 15) may be connected to one of the L-shaped bars 120 via a pinned connection through the apertures located on the tube 400 and also to the double lane extension tube 370 via a receiving device 390 located on one end of the tube 400 and another secondary connecting device 340 as described above. Although the lengths of the extension tubes may vary, in one embodiment, up to three different extension tubes may be connected to the primary tube and the lengths of the different extension tubes may be 2 feet, 4 feet and 11 feet.

Figure 16:
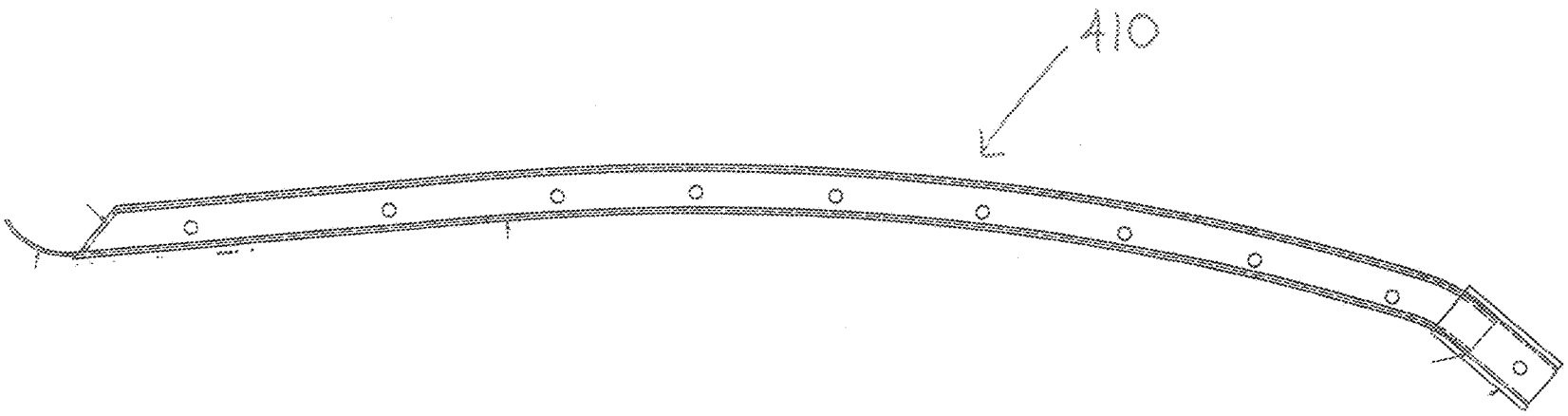
FIG. 16 is a perspective view of a hook portion of the primary barrel moving tube forming one aspect of this disclosure.

Turning to FIG. 16, at either end of the primary tube 290 opposite of the connection to any extension tubes, a curved bar or extension hook portion 410 may be pinned to the primary tube for moving traffic barrels in either the right or left lane of the highway. Specifically, the extension hook 410 may be unpinned and re-pinned to either end of the primary tube depending upon which lane the traffic barrels need to be removed, while flipping the vertical pin 420 (discussed in more detail below).

As shown in FIG. 1, various types of rollers 430, 440 may be mounted to the primary tube and/or any additional extension tubes (not shown). The hook 410 has a vertical pin 410 extending upwards at its distal end. The hook 410 and pin 420 is configured to ensure that when the apparatus contacts the traffic barrel, it is "caught" and moved along the extension element, rather than being pushed into the highway, which is disadvantageous for obvious reasons, especially when the apparatus is being operated adjacent to a lane of ongoing traffic. As discussed above, at the end opposite of the hook, the primary tube 290 is configured to be able receive the different extension rods.

FIG. 1 depicts the primary tube 290 having two distinct types of rollers. Specifically, the middle portion of the primary tube 290 has substantially cylindrical rollers 430 positioned in pairs on the top and bottom of the primary tube. Each end of the primary tube adjacent to the middle portion has a second type of substantially round rollers 440. The round rollers 440 are also grouped in pairs, one round roller on top of the primary tube and one corresponding round roller on the bottom of the primary tube. The rollers are designed to improve barrel movement. Furthermore, the roller size, material, design and placement are determined to optimize multiple factors, including but not limited to safe barrel transport away from potentially head-on traffic and ensuring that the barrels are not damaged during the transport process. The diameter and length of these rollers may be varied to optimally distribute the weight of the barrel and the forces involved with barrel transport to minimize and/or eliminate unnecessary wear and tear of the barrels during transport. It should be appreciated that the primary tube may be configured to have only a single type of rollers or different rollers as illustrated in FIG. 1.

In one embodiment, a plurality of rollers may be attached to a front edge of the primary tube and any extension tubes. Once the traffic barrel is engaged by the hook, the equally spaced rollers contact the barrel and move it along the extension element. The barrel slides along the angled extension element until they come to a desired position at the opposite end of the tube(s). Advantageously, the vehicle may be driven by a single worker to move the traffic barrels. Furthermore, additional workers are not necessary for placing the barrels at a desired location because the device is able to move the barrels into a desirable and repeatable location. Another embodiment of the apparatus may be used without the plurality of rollers. Furthermore, the rollers may be attached to the front edge of the hook.

In use, the vehicle V may be driven at a constant rate of speed, such as 10 miles per hour (MPH) along the highway. At this constant rate of speed, the tube(s) may be used to engage a traffic barrel at the hook end and the traffic barrel slides along the plurality of rollers along the front edge of the extension element to the opposite end of the extension element. As the traffic barrel slides off the opposite end of the tube(s), it is positioned away from the highway in a desired location. If the vehicle is driven at a constant speed, each barrel that is moved is positioned and aligned with the other barrels at a desired location away from the highway. As a result, only a single worker, i.e., the driver, is needed to move the barrels from the highway to a desired location. Importantly, all the parts are replaceable and interchangeable due to the pinned connections, so work may be performed on the device on site, rather than requiring transport to a repair shop or the base of the operations, which makes it easier to make modifications and adjustments to the device depending upon the particular conditions on the highway.

The foregoing descriptions of various embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the disclosure in various embodiments and with various modifications as are suited to the particular use contemplated.

The invention claimed is:

1. An apparatus removably attached to a vehicle for moving a plurality of traffic barrels, comprising: a mounting device configured for removably attaching to the vehicle; a receiving device having a first end and a second end, said receiving device configured for attaching to the mounting device at the first end; and at least one tube having opposed ends, said at least one tube connecting to the second end of the receiving device; an extension hook removably attached to either of the opposed ends of the at least one tube for capturing each of the plurality of traffic barrels; and a plurality of rollers are positioned on the at least one tube for aiding in sliding the plurality of traffic barrels into the desired position, wherein each of the plurality of rollers includes a pair of rollers, a first roller of the pair of rollers is positioned on a top of the at least one tube and a second roller of the pair of rollers is positioned on a bottom of the at least one tube for facilitating improved movement of the plurality of traffic barrels, whereby each of the plurality of traffic barrels slide along the at least one tube into a desired position.

2. The apparatus according to claim 1, wherein the mounting device is configured to be adjusted for mounting to different types of vehicles.

3. The apparatus according to claim 1, wherein the plurality of rollers are equally spaced along the at least one tube.

4. The apparatus according to claim 1, wherein the plurality of rollers include two different types of rollers.

5. The apparatus according to claim 1, wherein a vertical pin is attached to a distal end of the extension hook.

6. The apparatus according to claim 1, wherein the at least one tube extends away from a front face of the vehicle at an approximately forty-five degree angle.

7. An apparatus for moving a plurality of traffic barrels, comprising: a mounting bracket; a receiving device configured for attaching to the mounting bracket; a connecting device configured for attaching to the receiving device; and a primary barrel moving tube having opposed ends, said primary barrel moving tube configured to connect to the connecting device for moving the plurality of traffic barrels; and an extension hook removably pinned to either of the opposed ends of the primary barrel moving tube; and a plurality of rollers are positioned on the primary barrel moving tube for aiding in sliding the plurality of traffic barrels into the desired position, wherein each of the plurality of rollers includes a pair of rollers, a first roller of the pair of rollers is positioned on a top of the primary barrel moving tube and a second roller of the pair of rollers is positioned on a bottom of the primary barrel moving tube for facilitating improved movement of the plurality of traffic barrels.

8. The apparatus according to claim 7, wherein the mounting bracket has two parallel spaced horizontal bars.

9. The apparatus according to claim 8, wherein the mounting bracket has a first pair of horizontal spacers corresponding to one of the parallel spaced horizontal bars and a second pair of horizontal spacers corresponding to a second one of the parallel spaced horizontal bars.

10. The apparatus according to claim 9, wherein the first and second pair of horizontal spacers are configured to enable the device to be adjusted for mounting to different vehicles.

11. The apparatus according to claim 8, wherein the mounting bracket has at least one vertical tube for connecting the two parallel spaced horizontal bars.

12. The apparatus according to claim 7, wherein the receiving device has a plurality of bars extending outward in a direction perpendicular to the mounting bracket, said plurality of bars meeting at a connection point.

13. The apparatus according to claim 12, wherein a body shield is positioned on the receiving device above the connection point.

14. The apparatus according to claim 13, wherein the connecting device has a first part connecting to the receiving device and a second part connecting to the tube.

15. The apparatus according to claim 14, wherein the second part is a clevis fastener.

16. The apparatus according to claim 15, wherein the connecting device has a caster wheel.

17. A system for utilizing a vehicle to move a plurality of traffic barrels from a first position to a second position, comprising: a mounting device removably attaching to a front of the vehicle; an extension tube having a body with a curved hooked end and a plurality of rollers extending substantially along an entirety of the body; said extension tube configured for contacting the plurality of traffic barrels; wherein each of the plurality of rollers includes a pair of rollers, a first roller of the pair of rollers is positioned on a top of the extension tube and a second roller of the pair of rollers is positioned on a bottom of the extension tube for facilitating improved movement of the plurality of traffic barrels, whereby the curved hooked end of the extension tube engages one of the plurality of traffic barrels at the first position and the plurality of rollers slide the one of the plurality of traffic barrels along the body of the extension body into the second position.

* * * * *